US005280325A

United States Patent [19]

Yamada et al.

[11] Patent Number: 5,280,325

[45] Date of Patent: Jan. 18, 1994

[54] IMAGE FORMATION METHOD AND APPARATUS FOR FORMING A PLURALITY OF IMAGES IN DIFFERENT POSITIONS ON A RECORDING SHEET

[75] Inventors: Takanobu Yamada; Kazunobu Maekawa, both of Toyokawa, Japan

[73] Assignee: Minolta Camera Kabushiki Kaisha, Osaka, Japan

[21] Appl. No.: 616,936

[22] Filed: Nov. 21, 1990

[30] Foreign Application Priority Data

Nov. 27, 1989 [JP] Japan ..... 1-308661

[51] Int. Cl.[5] ..... G03G 15/14

[52] U.S. Cl. ..... 355/272; 355/327; 430/126

[58] Field of Search ..... 355/271, 272, 274, 326, 355/327, 277; 430/126, 54, 42

[56] References Cited

U.S. PATENT DOCUMENTS

| | | | |
|---|---|---|---|
| 4,181,423 | 1/1980 | Pressman et al. | 430/42 X |
| 4,515,460 | 5/1985 | Knech et al. | 355/327 |
| 4,766,463 | 8/1988 | Watanuui et al. | 355/272 |
| 4,771,319 | 9/1988 | Hamakawa | 355/319 |
| 4,933,727 | 6/1990 | Mizuma et al. | 355/327 |
| 5,040,026 | 8/1991 | Jamzadeh et al. | 355/271 |
| 5,099,286 | 3/1992 | Nichise et al. | 355/272 |
| 5,194,902 | 3/1993 | Kamimura et al. | 355/277 |

FOREIGN PATENT DOCUMENTS

| | | |
|---|---|---|
| 62-100777 | 5/1987 | Japan . |
| 63-14177 | 1/1988 | Japan . |
| 1-126074 | 5/1989 | Japan . |

*Primary Examiner*—Lincoln Donovan
*Assistant Examiner*—Christopher Horgan
*Attorney, Agent, or Firm*—Burns, Doane, Swecker & Mathis

[57] ABSTRACT

The present invention relates to an image formation method and the apparatus thereof. An electrostatic latent image formed on a photosensitive body is developed with toner, and the developed toner image is electrostatically transferred onto a recording sheet held on a transfer drum; in repeating the process a plurality of images are formed on the recording sheet. The electric charge on the transfer drum is increased by repeating the electrostatic transfer of the toner image, which can cause a trouble; therefore each time an image formation is completed, the charge on the transfer drum is removed. When a part of the recording sheet held on the transfer body on which the toner image is previously formed faces the photosensitive body, the transfer body is controlled to be apart from the photosensitive drum not to disarrange the image which is previously formed on the recording sheet.

10 Claims, 6 Drawing Sheets

IMAGE FORMATION METHOD AND APPARATUS FOR FORMING A PLURALITY OF IMAGES IN DIFFERENT POSITIONS ON A RECORDING SHEET

BACKGROUND OF THE INVENTION

1. Field of the Invention

The present invention relates to an image formation method and the apparatus thereof and, in particular, to an image formation method for forming a plurality of images on a recording sheet and an image formation apparatus for executing the method.

2. Description of the Related Art

As an apparatus for forming a plurality of images on a recording sheet, for example, there is one disclosed in Japanese Patent Laid-open No. Sho 63-14177. The apparatus is so arranged that a plurality of images are formed in the rotary direction of a photosensitive body by exposing a rotating manuscript being held on a rotary manuscript drum, and also a plurality of images are formed in the width direction of the photosensitive body by providing a plurality of projection lenses in parallel. In the apparatus, however, a special constitution is needed and a manuscript size is also limited for copying. Furthermore, since the manuscript is held on the drum, it is impossible to form different kinds of images on a single recording sheet.

On the other hand, as an apparatus in which different images can be formed on a sheet, there is one disclosed in U.S. Pat. No. 4,771,319. In the apparatus, a first toner image formed on a photosensitive body is transferred onto the front half of a recording sheet and after fixing the sheet, the sheet is resupplied to a transfer portion for transferring a second toner image formed on the photosensitive body onto the rear half of the sheet. In the apparatus, however, each time the images are formed, the fixing processes have to be performed, which is a big burden for the recording sheet, and there is more of a probability of the occurrence of a jam. The recording sheet on which the images are formed is once housed in an intermediate tray and after that the sheet is resupplied, so that a quite long period of time is needed for copying a sheet of manuscript.

SUMMARY OF THE INVENTION

An object of the present invention is to provide an improved image formation method with which a plurality of images can be formed on a recording sheet.

Another object of the present invention is to provide an image formation method with which, when a plurality of images are formed on a recording sheet in repeating transfer processes for transferring a toner image formed on a photosensitive image formation body onto a recording sheet, good images are obtained at all times by preventing the accumulation of electric charge on the recording sheet on which the images are to be transferred.

A further object of the present invention is to provide an improved image formation apparatus with which a plurality of images can be formed on a recording sheet.

Yet another object of the present invention is to provide an improved image formation apparatus capable of preventing an increase in electric charge on a recording sheet which is produced by the transfer of a toner image.

A still further object of the present invention will be made clear in the detailed description of the invention referring to the drawings.

DETAILED DESCRIPTION OF THE PREFERRED EMBODIMENTS

Figure 1:
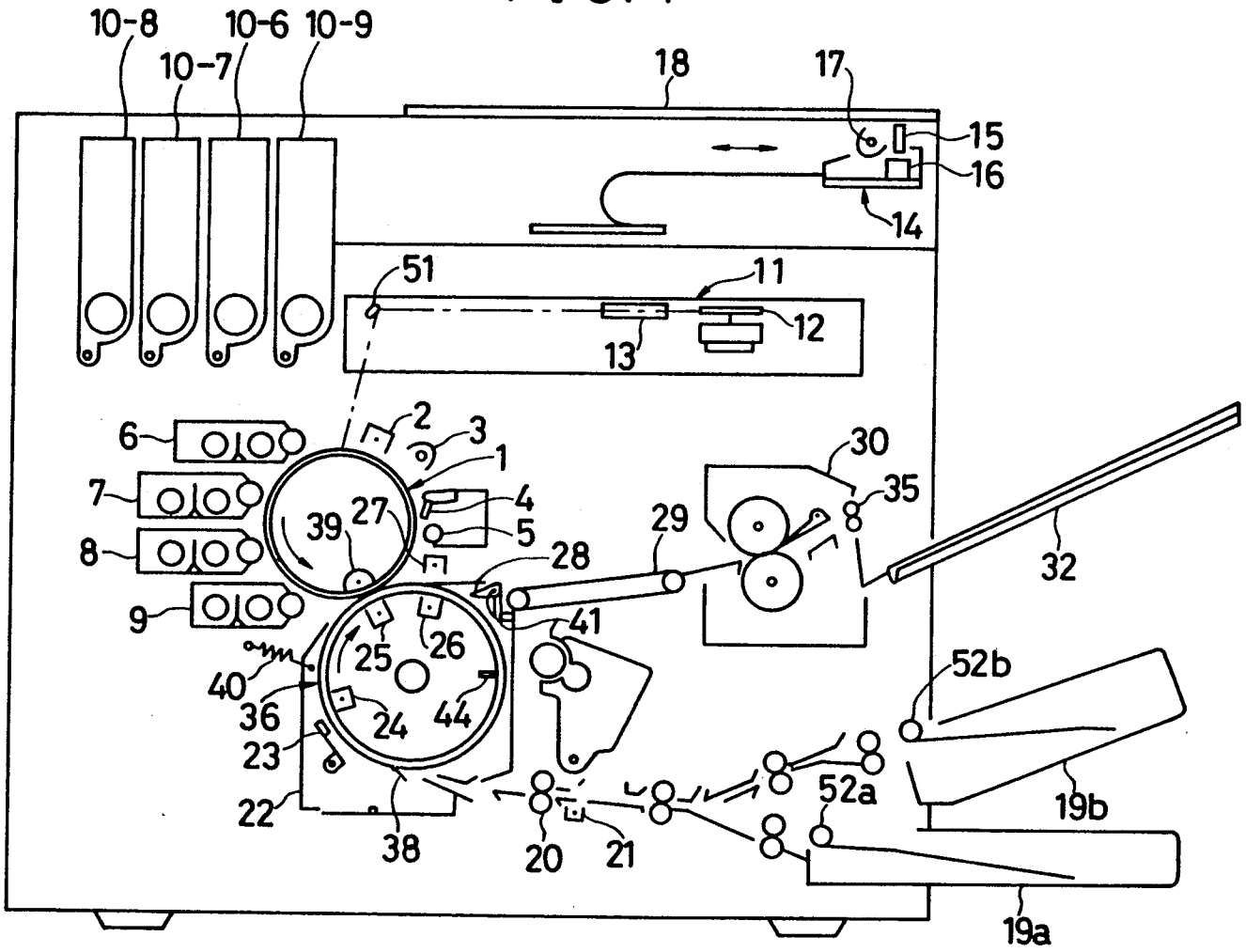
FIG. 1 is a cross sectional view of a color copying machine in an embodiment according to the present invention.

FIG. 1 shows an example of a color copying machine to which an image formation method of the present invention is applied for the formation of color images.

As shown in FIG. 1, a manuscript placed on a manuscript glass 18 is scanned by a scanner 14 comprising an exposure lamp 17, a convergent optical lens array 15 and a CCD line sensor 16, and is read by the sensor 16 as color signals of three primary colors, R (red), G (green) and B (blue). These color signals, R, G and B, are converted into ternary or quaternary signals of Y (yellow), M (magenta) and C (cyanogen), or Y, M, C and Bk (black), and they are sent to a laser optical system 11 as output signals. A copying machine shown in the present embodiment does not have an image memory enough for three colors. Because of this, when an image of each color is formed, the scanner 14 scans a manuscript three times or four times, and as a result, signals of Y, M and C or signals of Y, M, C and Bk are successively sent to the laser optical system 11.

The laser optical system 11 comprises a polygon mirror 12, f$\theta$ lens 13, reflection mirror 51, etc., and it irradiates a photosensitive drum 1 for exposure with image forming laser beams for individual colors based on the signals of Y, M and C, or the signals of Y, M, C and Bk.

The photosensitive drum 1 is driven to rotate in a direction indicated by an arrow. The surface of the photosensitive drum 1 is constituted of an organic photosensitive body where an electric charge generation layer and an electric charge transportation layer are laminated on a conductive substrate and, in particular, a photosensitive body having a high sensitivity for a laser beam of the wave length in the vicinity of 780 nm is used. In the present embodiment, the surface of the photosensitive body is charged to be negative potential by an electrification charger 2.

An image formation system in the present apparatus is a so-called N P system in which a positive image is obtained from a negative image; the photosensitive drum 1 is exposed by a laser beam for forming an image, and the thus formed electrostatic latent image is developed with toner charged to be in negative potential.

Around the photosensitive drum 1, there are provided a drum cleaner 4, a toner collecting roll 5, an eraser lamp 3, the electrification charger 2, and further four kinds of developing devices. A first developing device 6 supplies yellow colored toner, a second developing device 7 supplies magenta colored toner, a third developing device 8 supplies cyanogen colored toner and a fourth developing device 9 supplies black colored toner respectively to the electrostatic latent image. Each of developing devices 6, 7, 8 and 9 is respectively supplied toner from each of corresponding toner hoppers 10-6, 10-7, 10-8 and 10-9 through each of transfer pipes (not shown in the drawing) based on each supply signal.

Recording sheets of paper, OHP film, etc. are housed in paper-supply cassettes 19*a* and 19*b* in an accumulated state, and they are conveyed toward the inside of the apparatus one by one by paper-supply rollers 52*a* and 52*b*. A recording sheet to be conveyed is once stopped when the tip of the sheet is abutted against a timing roller 20 at a standstill, and the following conveyance timing is adjusted by the timing roller 20. A paper sensor 21 is used for this purpose.

A transfer drum 36 is provided between the timing roller 20 and the photosensitive drum 1. The transfer drum 36 is driven to rotate in a direction indicated by an arrow, and is used for the transfer of an image from the photosensitive drum 1 while holding the recording sheet conveyed through the timing roller 20.

The transfer drum 36 is principally composed of a drum frame and a dielectric film being supported by the drum frame and stretched in a cylindrical form, and a claw 38 for chucking the tip of the recording sheet is provided. The claw 38 is opened or closed, when there is a need to, by the action of a cam (not shown in the drawing) provided inside the transfer drum 36. The dielectric film is generally composed of a polyester film of about 100 to 200 μm thick, but the film is not limited to the one described above.

A position sensor 44 is disposed inside the transfer drum 36. The position sensor 44 is for generating a signal for starting the scanner 14 to make the tip position of the recording sheet held on the transfer drum 36 coincide with that of the first toner image formed on the photosensitive body; the position sensor 44 is turned on when the transfer drum 36 is rotated by a prescribed angle after the chucking of the recording sheet.

Figure 2:
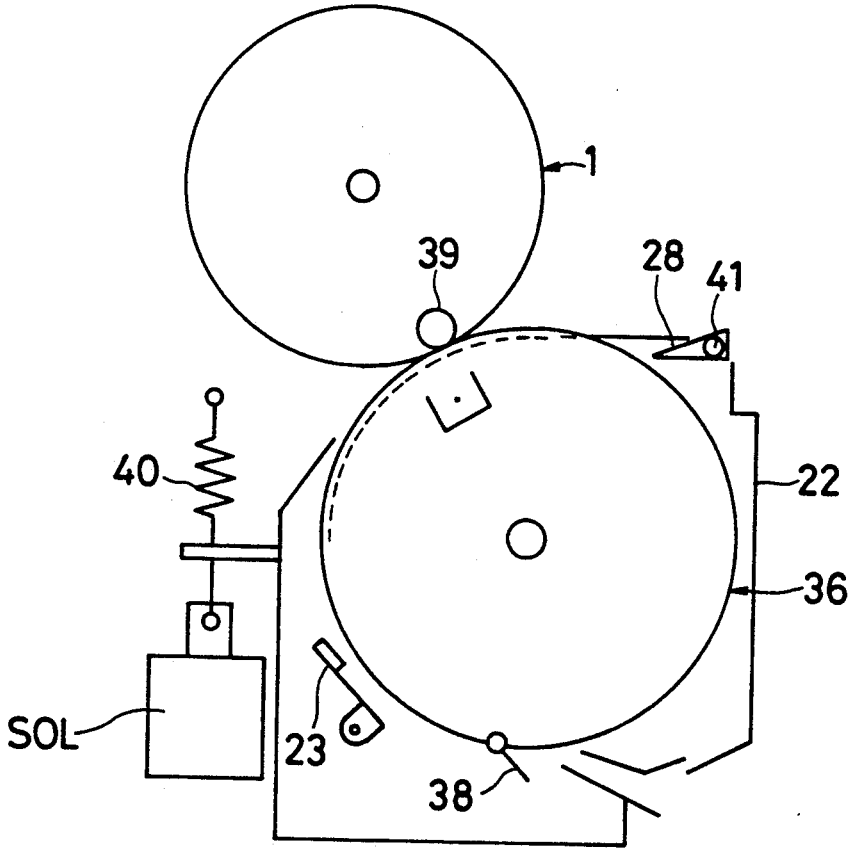
FIG. 2 is a side view showing the supporting structure of a transfer drum.

As shown in FIG. 1, a frame 22 holding the transfer drum 36 is supported rotatably centering a pivot 41 by the apparatus, and as shown in FIG. 2, it is biased clockwise by a spring 40, and a solenoid SOL is connected to it. Normally the solenoid SOL is kept OFF and the transfer drum 36 is pressed and abutted, with pressure of the spring 40, against a positioning roller 39 disposed on the side of the photosensitive drum 1 and the clearance between the photosensitive drum 1 and the transfer drum 36 is kept constant at about 0.1 to 0.5 mm, and when a toner image formed on the recording sheet held on the transfer drum 36 opposes the photosensitive drum 1, the solenoid SOL is activated to separate the transfer drum 36 apart from the photosensitive drum 1 for preventing the toner image on the transfer drum from becoming smudged.

The recording sheet conveyed to the transfer drum 36 through the timing roller 20 is held by the chucking claw 38 only by the tip thereof. The transfer drum 36 is charged to be in negative potential by an attraction charger 24 provided inside the transfer drum 36. On the other hand, the recording sheet on the surface of the transfer drum 36 is brought into contact with a grounded electrode 23 (zero potential) to thereby make the potential of the recording sheet to be zero. Therefore, the recording sheet is attracted and held electrostatically by the dielectric film on the surface of the transfer drum 36.

Figure 3:
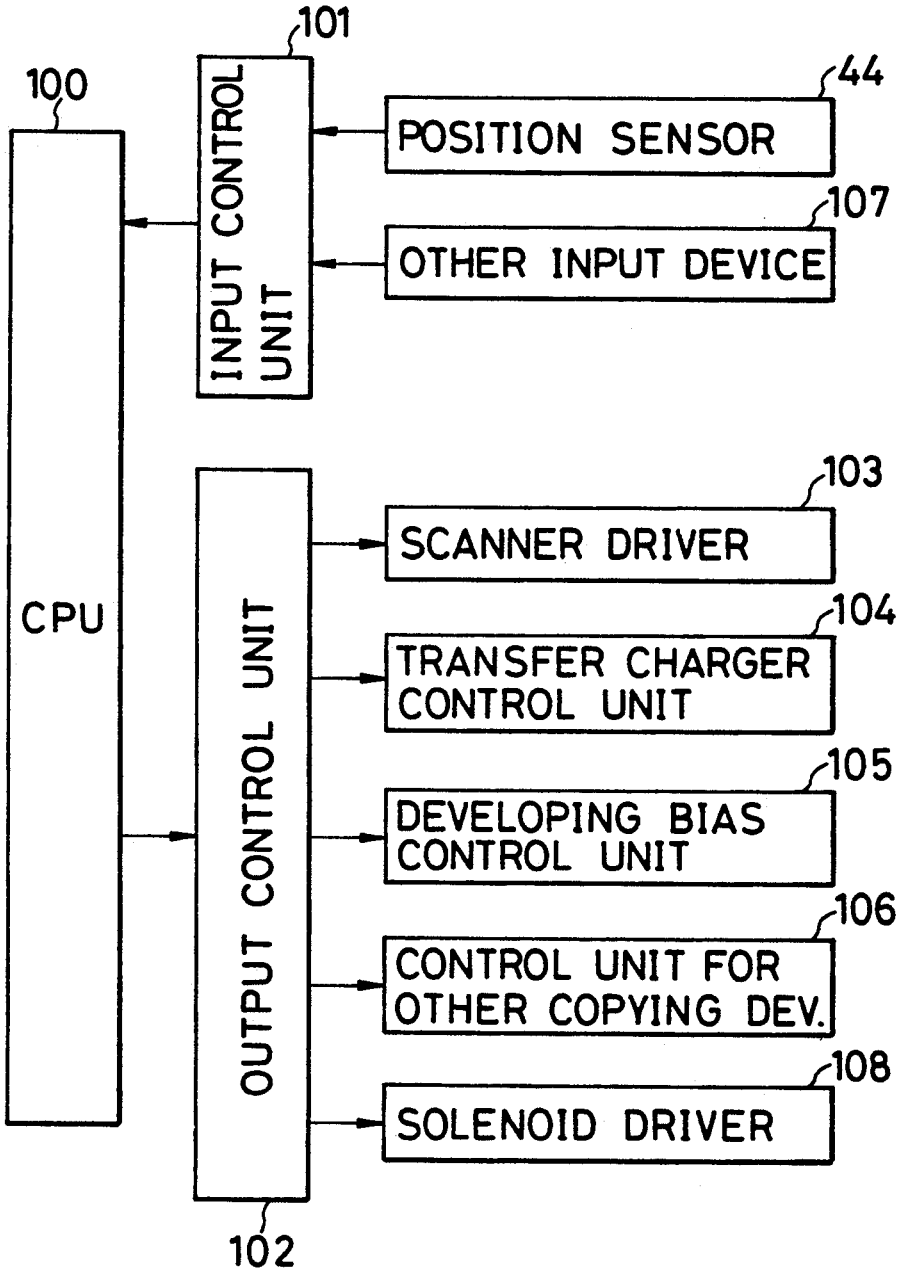
FIG. 3 is a block diagram of a control circuit.

As shown in FIG. 3, a CPU 100 is used for the control of the operation of the image formation apparatus; the position sensor 44 (FIG. 1) of the transfer drum 36 and other input device 107 are connected to the input control unit 101 of the CPU 100 a scanner driver 103 for driving the scanner 14, a control unit 104 for a transfer charger 25, a control unit 105 for a development bias, a solenoid driver 108 for driving the solenoid SOL, and a control unit 106 for other copying device are connected to the output control unit 102 of the CPU 100.

Figure 6:
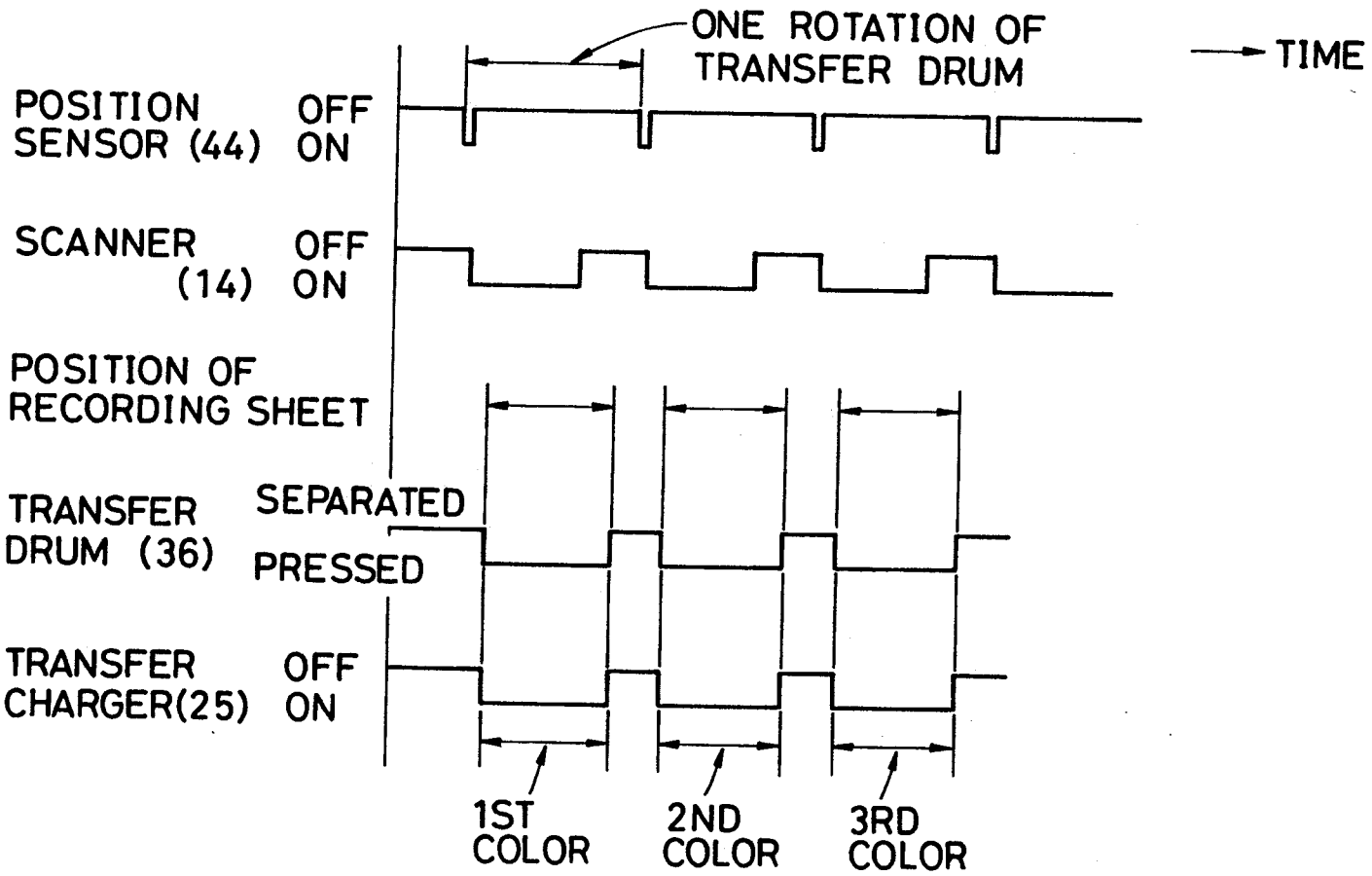
FIG. 6 is a time chart showing an image formation process in an ordinary color image formation mode.

Next, an image formation process in a normal color image formation mode will be explained referring to a time chart shown in FIG. 6.

At first, a color manuscript sheet is placed on the manuscript glass 18 of the image formation apparatus, and a start button is depressed. When the position sensor 44 provided inside the transfer drum 36 is turned on, the scanner 14 is activated and scanning is performed. In the first scanning, an image signal of the first color obtained by color separation is obtained, and the signal is inputted to the laser optical system 11 and an electrostatic latent image is formed on the photosensitive drum 1. The electrostatic latent image is developed by the developing device 6 for the first color, yellow, and when the transfer drum 36 is abutted and pressed against the photosensitive drum 1, the toner image is transferred onto a recording sheet held on the surface of the transfer drum 36 by electric discharge of the positive charge by the transfer charger 25 provided inside the transfer drum 36.

The transfer charger 25 is activated during a period of time when the recording sheet T, from the front edge to the rear edge, passes through the transfer portion.

During the period of time when the recording sheet is being developed by the yellow developing device 6 and an image processing is being performed, the other developing devices 7 to 9 are kept in such a state that they are prohibited from performing development, so as not to disturb the image developed by the yellow developing device 6.

The development and transfer processes as described above are repeated the necessary number of times by selectively using specified developing devices corresponding to the color information and the color assignment of an image to be formed.

When the last transfer process is completed, removal chargers 26 and 27 are activated, and the chucking claw 38 is opened by a cam (not shown in the drawing), to release the electrostatic hold of the recording sheet by the transfer drum 36 and the chucking hold of the recording sheet, so that the recording sheet is certainly separated from the transfer drum 36 by a separation claw 28 and sent to a conveyance portion 29. The removal charger 26 reduces the attraction force between the dielectric film and a transfer sheet by AC current for removing mainly the charge of the dielectric film. The charger 27 disposed so as to oppose the removal charger 26, with the dielectric film therebetween, mainly removes charge on the surface of the recording sheet when the recording sheet is separated from the transfer drum 36, and prevents electric discharge which occurs with the separation and also prevents the toner on the transferred image from splashing.

After that, the toner image on the recording sheet is fixed thereon by a heat fixing roll of a fixing unit 30, and is discharged onto a paper ejection tray 32 through a paper ejection roller 35. An image on the ejected recording sheet can be an image of any color depending on the frequency of development and transfer, and the colors of toner used for the development. Of course, a uni-colored image can be obtained.

Next, an image formation process in a continuous copying mode in which a plurality of images are formed on a recording sheet will be explained referring to a time chart shown in FIG. 7.

Figure 4:
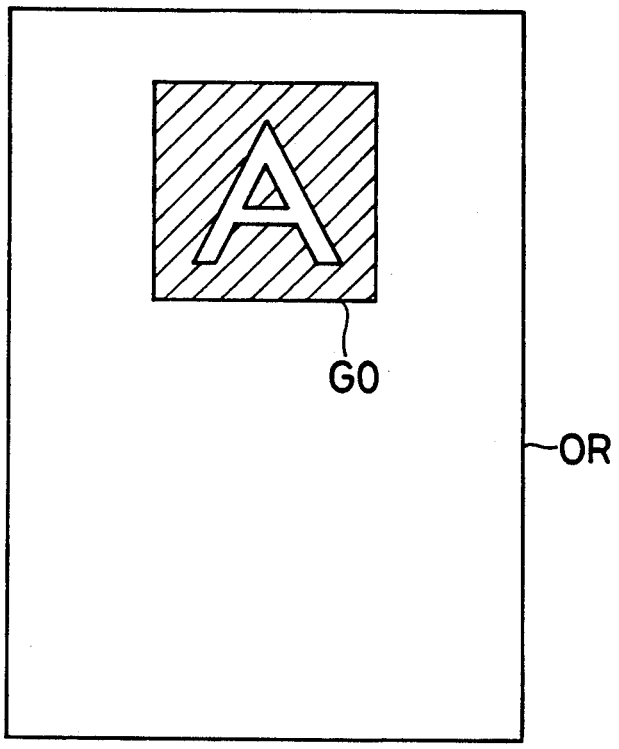
FIG. 4 is a plan view showing an example of manuscript.

This mode is, to be concrete, as shown in FIG. 4, a partial manuscript image G0 having a size smaller than that of a recording sheet on a manuscript sheet OR (or a manuscript image G0 whose size is reduced to be smaller than the size of a recording sheet) is transferred a plurality of times on a recording sheet T to form transfer images G1, G2, - - - . The number of images to be formed can be increased as far as there is space on the recording sheet T, and it will be decided corresponding to a need.

Figure 5:
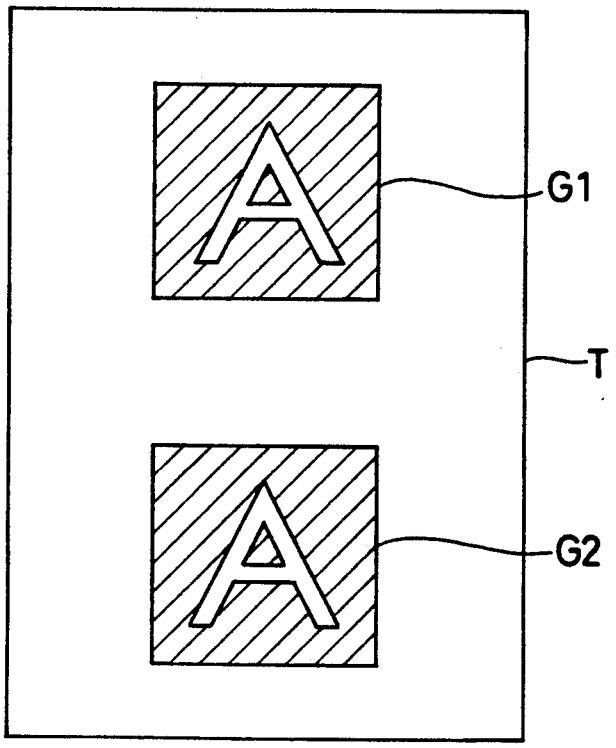
FIG. 5 is a plan view of a recording sheet on which a plurality of identical images are formed.

As shown in FIG. 5, a case where two images G1 and G2 are formed will be explained.

At first, the tip of the manuscript sheet OR is coincided with the end of the manuscript glass 18 such that the manuscript image G0 is placed at the scan start side, and then a start button is switched on. Scanning is started synchronously with the turning ON of the position sensor 44 provided inside the transfer drum 36. In this embodiment, the scanner 14 returns to its original position when it scans up to the center position of the manuscript sheet OR. The first color signal read by the scanner 14 is, as explained above, transmitted to the laser optical system through an image processing circuit which performs image processes such as color conversion, and the exposure and development for the first color are performed, and a toner image formed on the photosensitive drum 1 is transferred onto the recording sheet T by the transfer charger 25.

The transfer charger 25 is activated during a period of time when the recording sheet T, from the front edge to the rear edge, passes through the transfer portion. In this embodiment, since an image memory is not provided, similarly to the case of the first color, the processes of scanning, development and transfer are repeated concerning the second and the third colors, and the first color image G1 is formed on the recording sheet T.

In a transfer method using the dielectric film, each time the transfer charger 25 is activated, electric charge is accumulated on the dielectric film, resulting in formation of a reverse electric field, which degrades transfer efficiency. To cope with this, if the potential of the transfer charger is raised in order when the images after the second image are formed, the potential can be too high to cause a problem such as leak.

Because of this, after the formation of the first image G1, the electric charge on the dielectric film and the recording sheet T is removed by the removal chargers 26 and 27 for the preparation of the formation of the next image G2. However, if the removal of electric charge is performed as described above, the electric charge of a toner image which has been transferred on the recording sheet T is also removed or decreased and it can cause the image to be re-transferred onto the photosensitive drum 1 or the image can be disarranged when the second image G2 is formed.

In the present embodiment to cope with this, when the second image G2 is formed, during a period of time when an image formation area for the first image G1 is facing the photosensitive drum 1, the solenoid SOL is turned on to keep the transfer drum 36 apart from the photosensitive drum 1, thereby controlling the recording sheet T to be apart from the photosensitive drum 1.

The formation of the second image G2 will be explained referring to FIG. 5 in the following. For this purpose, an image formation area is shifted on the lower side of the transfer sheet, that is, on the rear side in the scanning direction, therefore the scan-start timing of the scanner 14 is delayed for a period:

$$\frac{\text{an image formation area shift quantity}}{\text{system velocity of a copying machine}}$$

comparing to the start timing of the first image.

In a similar way to the case of the formation of the first image G1, the color image G2 can be obtained in the lower part of the recording sheet T by performing scanning, development and transfer concerning individual colors R, G and B.

In this case, the transfer charger 25 is activated during a period of time in which the recording sheet T, from the front edge to the rear edge, passes through the transfer portion in a similar way to the case of the first image formation.

If the combination of image color concentration of three or four colors of images formed in the upper part and the lower part of the recording sheet are different, color images of different color tones can be obtained on the recording sheet T side by side; when images of various color tones are to be made for trial for comparison or selection, the above-mentioned method is preferable to be adopted being excellent in the workability for image formation, comparison or selection.

In such a case, if it is desirable to form a plurality of images on the recording sheet T, the apparatus can cope with such a demand by reducing the size of the manuscript image G0 and making copies a plurality of times in changing the image area in order in the moving direction of the recording sheet T. In such an image formation mode, it is preferable that each time the transfer of an image is performed the electric charge on the dielectric film and the recording sheet T is removed, and in the case of the transfer of an image on and after the second image, during a period of time when an image already transferred on the recording sheet T faces the photosensitive drum 1, the transfer drum 36 is separated apart from the photosensitive drum 1.

The summary of processes of operation in the continuous copying mode of an identical image is as follows:

1. The number of images to be reproduced on a recording sheet in a scanning direction is determined.
2. A scanner is operated the number of times corresponding to the number of selected colors in each image reproduction.
3. A transfer charger is also operated each time each colored image is transferred on the recording sheet.
4. A removal charger is operated after each set of colored images, which produces one image to be reproduced, has been transferred on the recording sheet.
5. In the case of on and after the second image area, the scan-start timing is delayed in order by the shift quantity of an area from the preceding image formation area.
6. When the second image is transferred, during the period of time in which the image transferred already faces an image carrier, the transfer drum is kept apart from the image carrier.

7. If necessary, the images of different color tones can be formed by changing the color concentration of images formed on the recording sheet.

Figure 7:
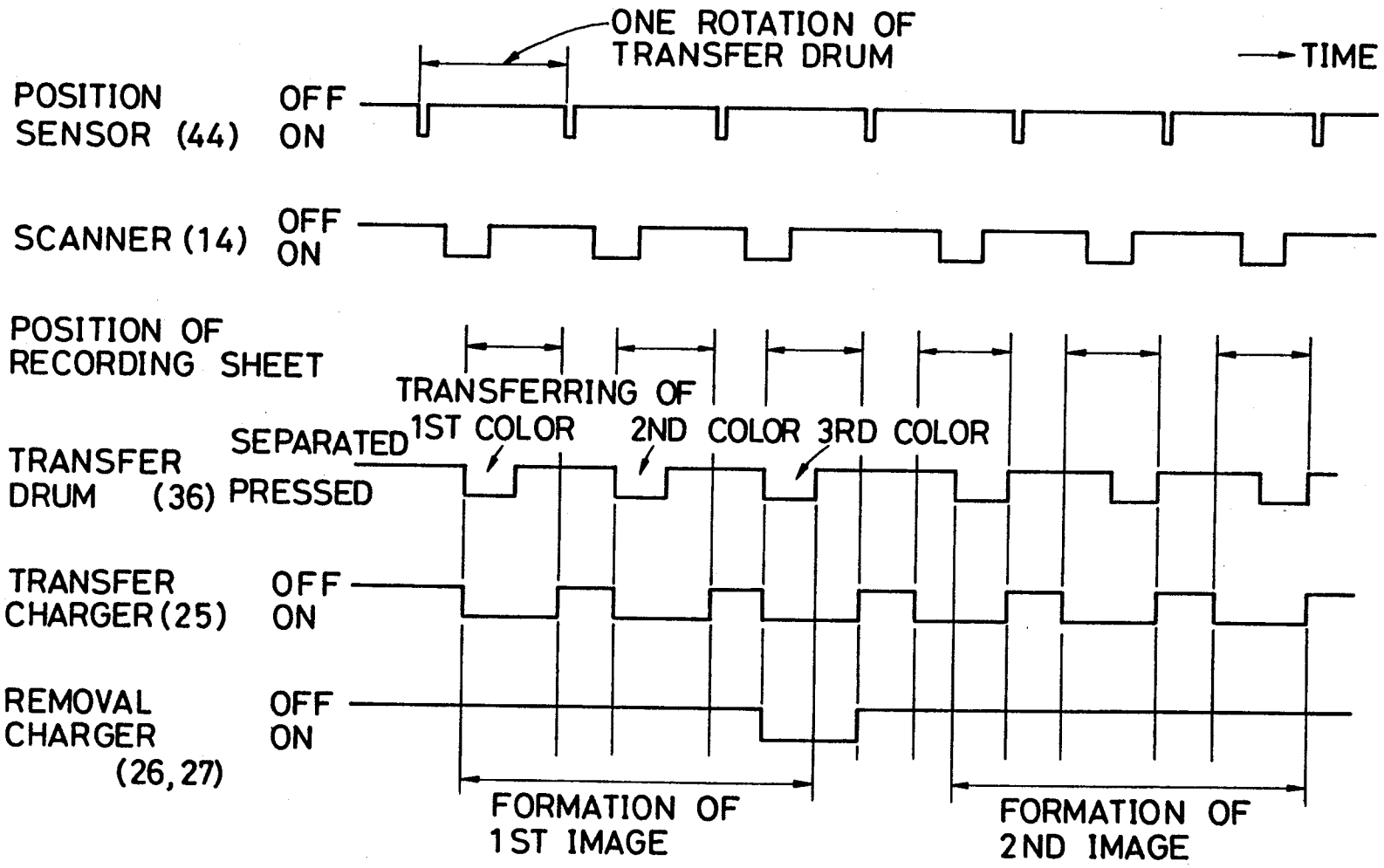
FIG. 7 is a time chart showing an image formation process in a continuous transfer mode.

As clearly shown in FIG. 7, the transfer charger 25 is kept on over the whole area of transfer sheet T, from the front edge to the rear edge. In the case of formation of the first image, the transfer drum 36 is pressed and abutted against the photosensitive drum 1 only when the first image formation area faces the photosensitive drum 1; in the case of formation of the second image, the transfer drum 36 is pressed and abutted against the photosensitive drum 1 only when the second image formation area faces the photosensitive drum 1. The removal chargers 26 and 27 are activated being timed to the last transfer process of a processed image, and they remove the charge on the dielectric film and the recording sheet T where the last transfer process of the processed image is finished; the area from which electric charge is to be removed by the removal chargers 26 and 27 corresponds to the area to which electric charge is given by the transfer charger 25.

Apart from the above, an apparatus can be considered to be the one in which the attraction charger 24 and opposite electrode 23 shown in FIG. 1 are omitted. In this case, the attraction between the dielectric film and the transfer sheet is achieved by the activation of the transfer charger.

Different color tones can be obtained on the sheet by using different developing bias levels for a upper side image and a lower side image.

In the embodiment described above, the transfer charger is turned on only when the transfer sheet passes through the transfer portion, but it can be turned on during the operation of image formation. In such a case, electric charge is given to a part where there is no recording sheet, so that it is necessary to operate the removal charger for a whole cycle of rotation of the transfer drum 36 for removing the charge.

In the embodiment described above, a manuscript image is once converted to digital data and then an electrostatic latent image is regenerated on the photosensitive body using the laser optical system. The present invention, however, is not limited to an image formation apparatus of a digital system, and it can be applied to an apparatus where a manuscript image is directly given for exposure onto the photosensitive body through a mirror optical system.

In the embodiment described above, a plurality of copies of the manuscript image are formed on the recording sheet, but the number of manuscript images is not limited to one, and it is also possible to form a plurality of transfer images from a plurality of manuscript images.

The following are descriptions on an apparatus according to the present invention: a transfer body is driven to rotate and hold the recording sheet with electrostatic attraction, thereby the recording sheet is repeatedly subjected to electrostatic transfer from the image carrier; a multicolored image can be formed by making toner images on the image carrier to be transferred in individual times be in different colors; when a small image is formed on the recording sheet, the recording sheet to be used for transfer is divided into a plurality of image areas and toner images are transferred successively to each of these image areas; thus a mode can be achieved in which a plurality of identical images can be formed on the recording sheet even in an image formation apparatus of digital system without having an image memory or in an image formation apparatus of an analog system; in the case of an image of a smaller size than a minimum-sized recording sheet, a plurality of identical images are formed on the recording sheet, thereby the number of supplying times of recording sheets, the number of chucking times and the necessary number of recording sheets can be made small for the number of formed images; and the comparison or selection of color tones of images is easily performed by giving a variety of color tones to the images formed on the recording sheet.

In executing the image formation in the mode as mentioned above, it is arranged to be able to prevent the transfer charge output in each transfer time from being accumulated on the dielectric transfer body caused by the removal of electric charge on the dielectric transfer body after the transfer of each image, thereby it is possible to avoid the degradation of transfer efficiency caused by the formation of a plurality of images or to avoid the problem of leakage by raising the transfer output in succession for the dissolution of the degradation of transfer efficiency.

Furthermore, when images are transferred on image areas on and after the second image area, the dielectric transfer body is separated apart from the image carrier to keep the image area on a transfer sheet on which the image has been already transferred apart from the image carrie. Thereby even if the charge on the transferred image on the recording sheet is removed or weakened and the attraction force between the dielectric transfer body and the transfer sheet is weakened by the influence of the removal of charge from the dielectric transfer body in each time of transfer, it is possible to prevent the transferred image on the recording sheet from being transferred back onto the image carrier or from being disarranged. Thus images of excellent quality can be formed.

What is claimed is:

1. An image formation method for forming a plurality of images on a recording sheet by electrostatically transferring a toner image formed on a photosensitive image carrier onto the recording sheet held on a transfer body disposed adjacent to the photosensitive image carrier comprising the following processes of:

(1) a first transfer process for electrostatically transferring a first toner image on the image carrier onto the recording sheet on the transfer body;

(2) a process for removing residual charge from the transfer body after the completion of the first transfer process;

(3) a process for moving the transfer body apart from the image carrier during a passing period of an area having the first toner image formed on the transfer body; and (4) a second transfer process for electrostatically transferring a second toner image on a different area from the area having the first toner image on the recording sheet formed thereon.

2. An image formation method according to claim 1, wherein said process for removing residual charge from the transfer body removes residual charge concerning a part of the transfer body where at least the second toner image is transferred.

3. An image formation method according to claim 1, wherein the second toner image is identical to the first toner image.

4. An image formation method according to claim 1, further comprising a process for transferring a third toner image on the part of the recording sheet on which the first toner image has been transferred, said third transfer process being executed before said residual charge removal process.

5. An image formation method according to claim 4, wherein the third toner image is the image having different color from that of the first toner image.

6. An image formation apparatus for forming a plurality of images on a transfer member, comprising:

a rotatable electrostatic latent image holding member;

developing means for developing with toner an electrostatic latent image formed on said image holding member;

a support means for supporting the transfer member adjacent to the said image holding member, said support means being rotatable in a single direction opposite to that of said image holding member;

a transfer means for electrostatically transferring the toner image on said image holding member onto the transfer member;

a drive means for moving the transfer member to a position apart from said image holding member; and a control means for actuating said drive means each time the toner image transferred previously on the transfer member comes to a position opposed to said image holding member.

7. An image formation apparatus according to claim 6, further comprising:

a removal means for removing residual charge on the transfer member; and a second control means for actuating said removal means before a portion of the transfer member without any toner image transferred comes to position opposed to said image holding member.

8. An image forming apparatus for forming at least a first image and a second image on a transfer member, comprising:

an electrostatic latent image holding member;

developing means for developing with toner an electrostatic latent image formed on said image holding member;

a support means for rotatably supporting the transfer member adjacent to said image holding member;

a transfer means for electrostatically transferring the toner image on said image holding member onto the transfer member;

a removal means for removing residual charge on the transfer member;

a drive means for moving the transfer member to a position apart from the said image holding member; and a control means for actuating said drive means when the first toner image transferred previously on the transfer member confronts said image holding member.

9. Ana image forming apparatus according to claim 8, further comprising:

a second control means for actuating said removal means before a portion of the transfer member on which the second toner image is to be transferred comes to a position opposed to said image holding member.

10. An image forming apparatus according to claim 8, wherein the second toner image is identical to the first toner image.

* * * * *